US008830017B2

(12) United States Patent
Yang et al.

(10) Patent No.: US 8,830,017 B2
(45) Date of Patent: Sep. 9, 2014

(54) MINI HIGH-POWER MAGNETIC LATCHING RELAY

(71) Applicant: Ningbo Forward Relay Corp. Ltd., Ningbo (CN)

(72) Inventors: Xiaoxia Yang, Ningbo (CN); Guozhang Gao, Ningbo (CN); Shuijun Wang, Ningbo (CN)

(73) Assignee: Ningbo Forward Relay Corp. Ltd, Ningbo (CN)

( * ) Notice: Subject to any disclaimer, the term of this patent is extended or adjusted under 35 U.S.C. 154(b) by 0 days.

(21) Appl. No.: 13/837,886

(22) Filed: Mar. 15, 2013

(65) Prior Publication Data

US 2014/0002216 A1 Jan. 2, 2014

(30) Foreign Application Priority Data

Jul. 2, 2012 (CN) ..... 2012 2 0321280

(51) Int. Cl.
*H01H 51/22* (2006.01)
*H01H 50/18* (2006.01)

(52) U.S. Cl.
CPC ..... *H01H 50/18* (2013.01)
USPC ..... 335/80; 335/78

(58) Field of Classification Search
USPC ..... 335/80
See application file for complete search history.

(56) References Cited

U.S. PATENT DOCUMENTS 2,827,529 A * 3/1958 De Fligue ..... 335/80
4,091,346 A * 5/1978 Nishimura et al. ..... 335/78
4,529,952 A * 7/1985 Nagamoto et al. ..... 335/81
4,614,927 A * 9/1986 Mikami et al. ..... 335/78
4,658,226 A * 4/1987 Maenishi et al. ..... 335/127
4,672,344 A * 6/1987 Schedele ..... 335/230
4,743,877 A * 5/1988 Oberndorfer et al. ..... 335/128
4,761,627 A * 8/1988 Bell ..... 335/128
4,951,016 A * 8/1990 Furtwaengler et al. ..... 335/80
5,008,641 A * 4/1991 Schedele ..... 335/80
5,191,306 A * 3/1993 Kaji et al. ..... 335/78
5,245,303 A * 9/1993 Aharonian ..... 335/78
5,389,905 A * 2/1995 Shibata et al. ..... 335/78
5,568,108 A * 10/1996 Kirsch ..... 335/130
5,801,608 A * 9/1998 Mader ..... 335/128
5,844,456 A * 12/1998 Mader ..... 335/78
5,864,271 A * 1/1999 Mader ..... 335/78
5,910,759 A * 6/1999 Passow ..... 335/78
5,994,987 A * 11/1999 Passow ..... 335/78
6,020,801 A * 2/2000 Passow ..... 335/78
6,025,766 A * 2/2000 Passow ..... 335/78
6,144,270 A * 11/2000 Mader et al. ..... 335/78
6,323,747 B1 * 11/2001 Mader et al. ..... 335/80

(Continued)

*Primary Examiner* — Shawki S Ismail
*Assistant Examiner* — Lisa Homza
(74) *Attorney, Agent, or Firm* — Matthias Scholl P.C.; Matthias Scholl

(57) ABSTRACT

A mini high-power magnetic latching relay comprising a base seat, an insulation sleeve, a push rod, a magnetic circuit, and a contact part. The magnetic circuit comprises a magnetic enclosure, an iron core, a yoke, and a winding; the winding comprising a coil former and a coil wrapped on the coil former. One end of the yoke is a U-shaped end; the iron core penetrates through the coil for forming a fixed connection with the other end of the yoke; and one end of the iron core is located at the center of the U-shaped end to form an E-shaped gap. The magnetic enclosure is formed by magnetic steel and armature vertically located on both ends of the magnetic steel.

7 Claims, 4 Drawing Sheets

(56) References Cited

U.S. PATENT DOCUMENTS

| | | | | |
|---|---|---|---|---|
| 6,426,689 | B1 * | 7/2002 | Nakagawa et al. | 335/78 |
| 6,633,214 | B2 * | 10/2003 | Mochizuki | 335/128 |
| 6,661,319 | B2 * | 12/2003 | Schmelz | 335/78 |
| 6,771,153 | B2 * | 8/2004 | Mochizuki | 335/78 |
| 6,788,176 | B2 * | 9/2004 | Schmelz | 335/80 |
| 6,949,997 | B2 * | 9/2005 | Bergh et al. | 335/78 |
| 7,161,104 | B2 * | 1/2007 | Bergh et al. | 200/305 |
| 7,616,082 | B2 * | 11/2009 | Katou | 335/83 |
| 7,642,884 | B2 * | 1/2010 | Bergh et al. | 335/78 |
| 7,710,224 | B2 * | 5/2010 | Gruner et al. | 335/78 |
| 8,222,981 | B1 * | 7/2012 | Zarbock et al. | 335/128 |
| 8,330,564 | B2 * | 12/2012 | Miller | 335/78 |
| 8,514,040 | B2 * | 8/2013 | Gruner | 335/177 |
| 2002/0125972 | A1 * | 9/2002 | Tibbetts et al. | 335/80 |
| 2003/0112103 | A1 * | 6/2003 | Schmelz | 335/128 |
| 2011/0067988 | A1 * | 3/2011 | Elliott et al. | 200/306 |

* cited by examiner

MINI HIGH-POWER MAGNETIC LATCHING RELAY

CROSS-REFERENCE TO RELATED APPLICATION

This application claims the benefit of priority under 35 U.S.C. §119 from Chinese Patent Application Number 2012200321280.2 filed on Jul. 2, 2012, now Patent No. CN 20265099 U granted on Jan. 2, 2013, the contents of which is hereby incorporated by reference in its entirety.

FIELD OF THE INVENTION

This invention relates generally to electrical relays, and more specifically to a mini high-power magnetic latching relay.

BACKGROUND OF THE INVENTION

Accompanied by extensive applications, more relays of different functions and structures have come into being, wherein electromagnetic relays and magnetic latching relays are the most common ones. A magnetic latching relay is a pulse-driven relay, which is available for self latching upon de-excitation of a coil (disappearance of pulse). However, most magnetic latching relays in the market are big in overall structure and unlikely to be used on printed circuit boards, thereby limiting the application scope of magnetic latching relays.

SUMMARY OF THE INVENTION

The technical issue to be solved by this invention is to provide a mini high-power magnetic latching relay of high load and small volume.

The invention provides the following solution to solve the aforesaid technical issue: A mini high-power magnetic latching relay, comprising a shield, a base seat, an insulation sleeve, a push rod, a magnetic circuit and a contact part. The magnetic circuit comprises a magnetic enclosure, an iron core, a yoke and a winding. The winding comprises a coil former and a coil wrapped on the said coil former. One end of the said yoke is a U-shaped end. Whereas the iron core penetrates through the coil for fixed connection with another end of the yoke; the end of the yoke is located at the center of the U-shaped end of the yoke to form an E shape. The magnetic enclosure is formed by the magnetic steel and the armature vertically located on both ends of the magnetic steel through injection. The shaft of the magnetic enclosure is connected to the coil former. The two armatures and the magnetic steel are formed into a U shape. The two armatures are collaterally inserted into the E-shaped gap formed by the iron core and the said yoke for proper alignment.

The contact part comprises a dynamic contact pair and a static contact pair inserted into the said base seat. The dynamic contact pair comprises a dynamic contact clip and a dynamic contact point. One end of the push rod is connected with the magnetic enclosure; another end of the said push rod is connected with the dynamic contact clip.

The push rod comprises a push seat and two push arms integrated with the push seat. The push seat is tapped with a mounting hole. The magnetic enclosure is integrated with a push shaft. The push shaft is inserted into the mounting hole. The upper part of the insulation sleeve is provided with two push grooves with position corresponding to that of the push arm. The push arm penetrates through the push groove. The end of the push arm is provided with two opposite slots. The upper part of the dynamic contact clip is provided with two U-notches with position corresponding to that of the push arm. The part of the said dynamic contact clip located on both sides of the U-notches is clamped into the slots to ensure stable pushing of the dynamic contact clip by the push rod, and prevents the end of push arm from disengagement from notches on the dynamic contact clip.

The coil former comprises a hollowed cylindrical shaft. The cylindrical shaft is located inside the insulation sleeve. The insulation sleeve is fixed and installed on the said base seat. One end of the cylindrical shaft is provided with a back plate. Another end of the said cylindrical shaft is provided with a connecting plate. The coil is wrapped on the cylindrical shaft. The iron core penetrates through the cylindrical shaft for riveting with the yoke. The back plate is located on the inner side of another end of the yoke. A side wall is integrated on both sides of the said connecting plate. The side wall is provided with a connecting hole. The magnetic enclosure is integrated with a coupling shaft. The coupling shaft is installed inside the connecting hole. The lower end of the connecting plate is integrated with a base plate. A slot is provided between the side wall and the base plate for insert of U-shaped end of the said yoke.

A chute that can facilitate installation of the magnetic enclosure on the coupling shaft is provided inside the side wall.

A positioning slot is integrated on both sides of lower end of the insulation sleeve, respectively. The base seat is integrated with a positioning block. The positioning slot is coupled with the positioning block.

One side of the magnetic enclosure as opposite to the armature is thick at the center and thin on both ends.

As compared with the prior art, the magnetic latching relay of the present invention is characterized in that the magnetic circuit part of this relay is compact in structure, which can minimize the overall volume of the relay to enable its application to the printed circuit board requiring a small sized relay and extension of the application field of the magnetic latching relay. Furthermore, the magnetic circuit part is in the structure of a balanced magnetic circuit that can ensure contact pressure of the magnetic latching relay, stable bouncing time and improved service life of the relay; moreover, as a slot used to insert the U-shaped end of the yoke is provided between the side wall of the coil former and the base plate, both side walls of the coil former in this structure are provided with elasticity, which can facilitate installation of magnetic enclosure to ensure more compact structure of the whole relay and reduced volume.

DETAILED DESCRIPTION OF THE PREFERRED EMBODIMENTS

Figure 1:
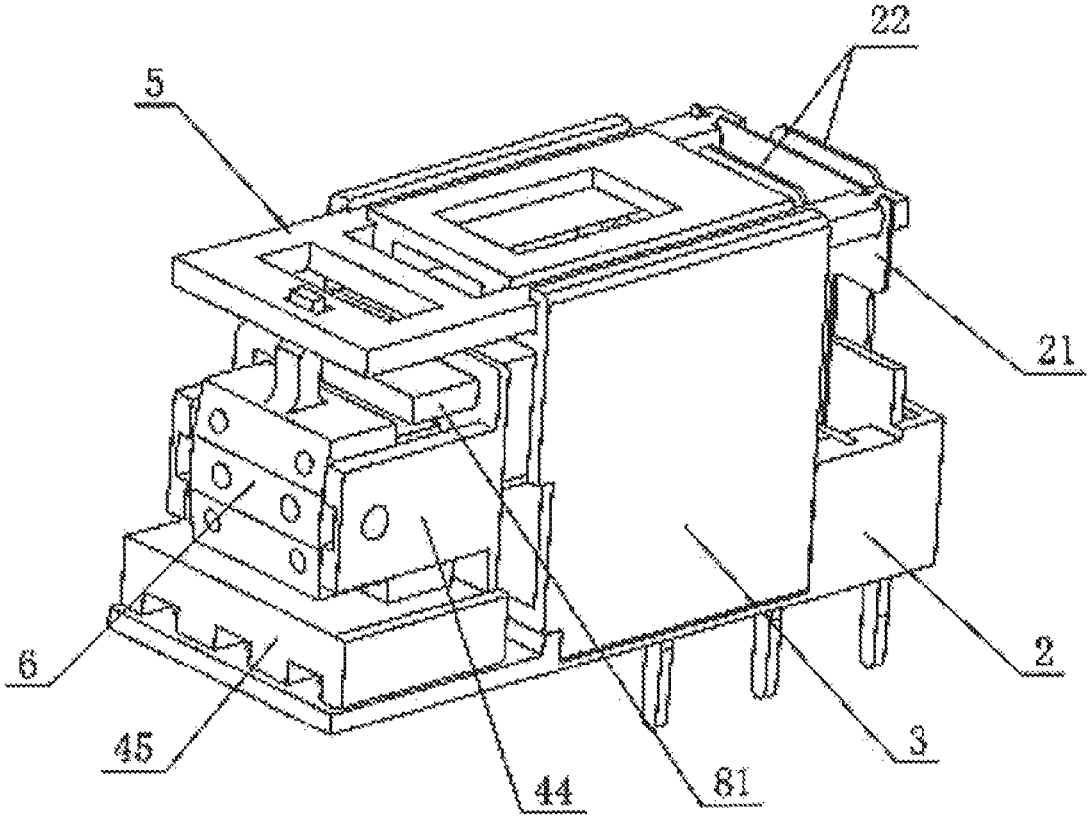
FIG. 1 is a perspective view of the mini high power magnetic latching relay of the present invention without its shield.
Figure 2:
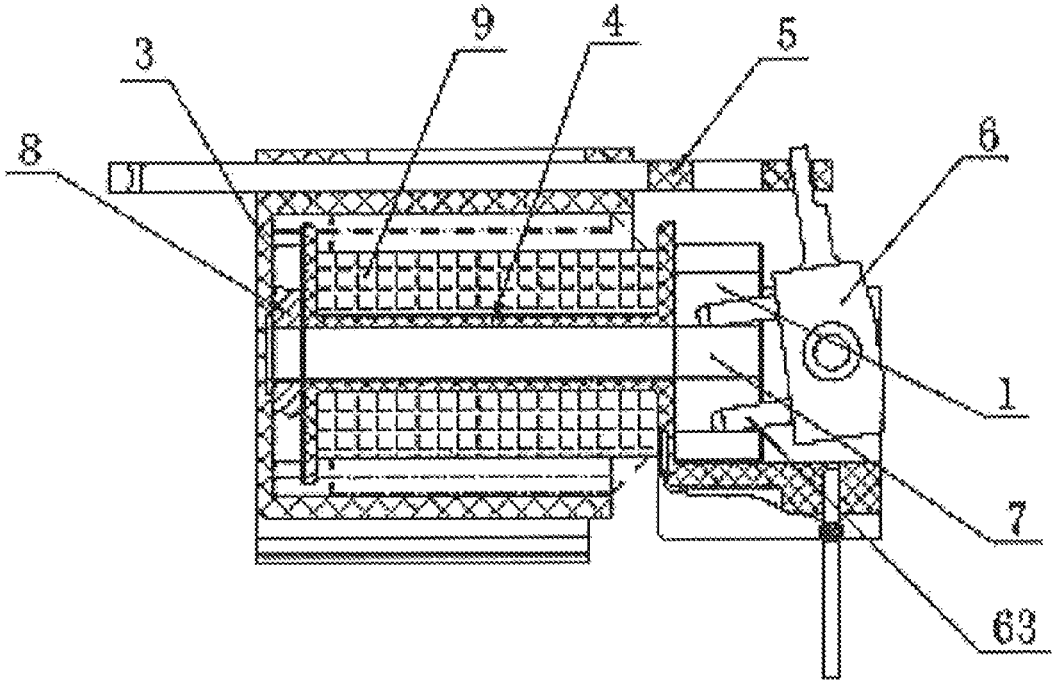
FIG. 2 is a side view of the magnetic circuit portion of the magnetic latching relay.
Figure 3:
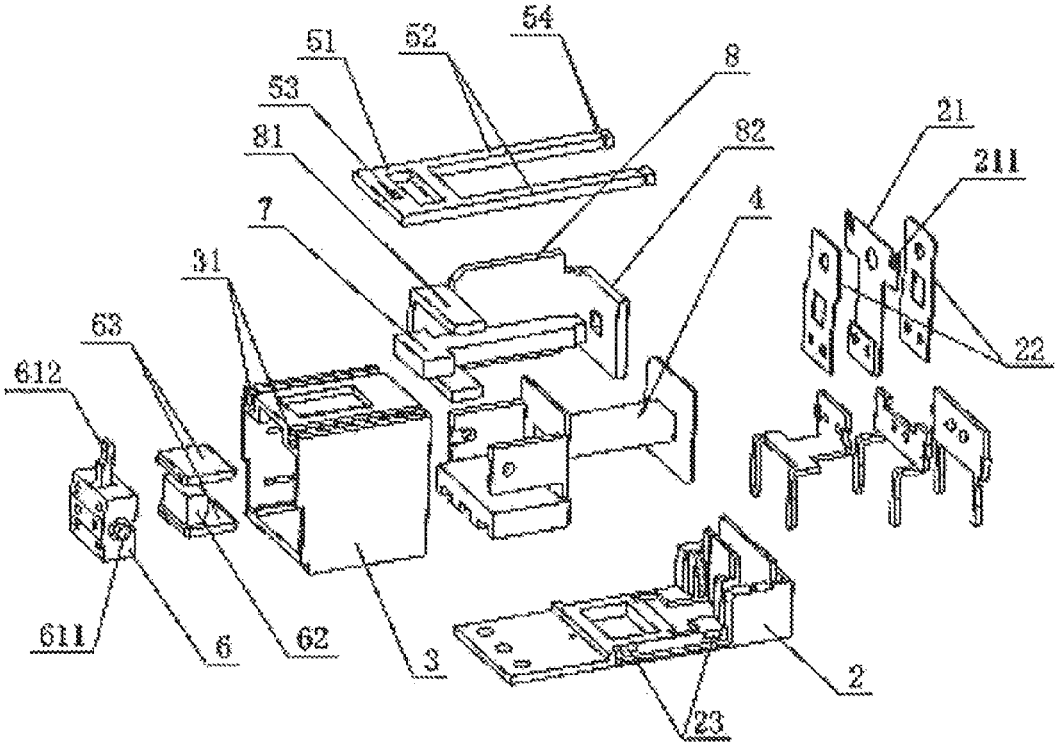
FIG. 3 is an exploded perspective view of the magnetic latching relay of FIG. 1.
Figure 4:
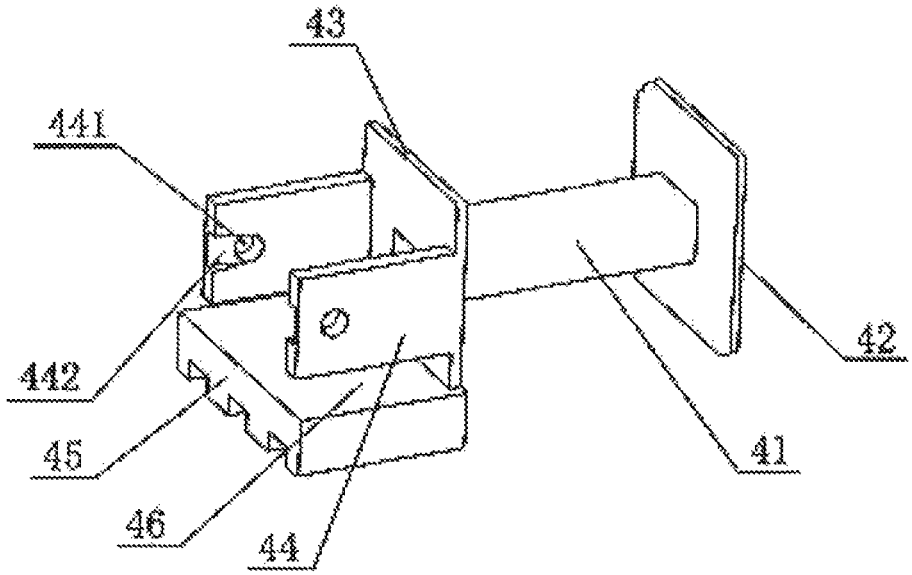
FIG. 4 is a perspective view of the coil former of the magnetic latching relay.
Figure 5:
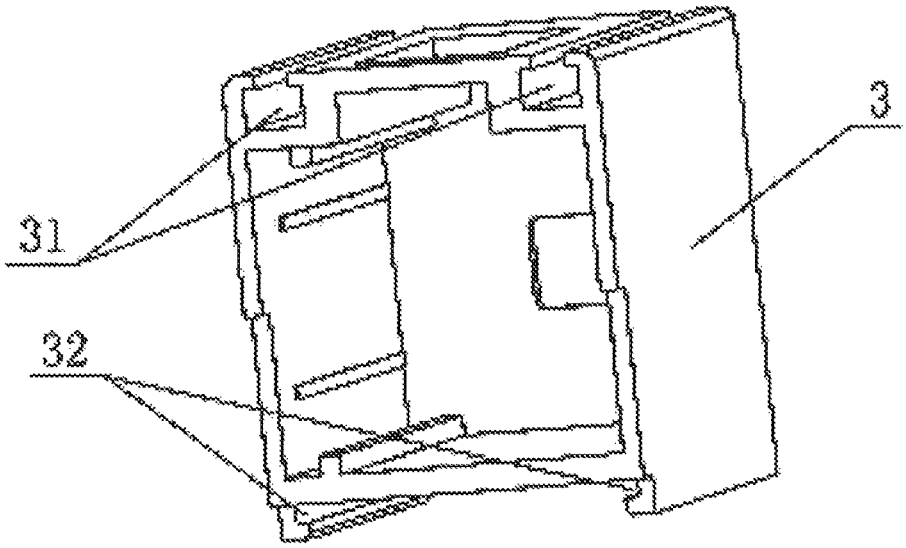
FIG. 5 is a perspective view of the insulation sleeve of the magnetic latching relay.

A detailed description of the structure of the preferred embodiments of the mini high power magnetic latching relay of the present invention is stated as follows:

A mini high-power magnetic latching relay as shown in FIGS. 1-5, comprises a shield (not illustrated), a base seat 2, an insulation sleeve 3, a push rod 5, and a magnetic circuit and a contact part. The magnetic circuit comprises a magnetic enclosure 6, an iron core 7, a yoke 8 and a winding. The winding comprises a coil former 4 and a coil 9 wrapped around the said coil former 4.

The coil former 4 comprises a hollowed cylindrical shaft 41. This cylindrical shaft 41 is located inside the insulation sleeve 3. One end of the cylindrical shaft 41 is provided with a back plate 42. Another end of the cylindrical shaft 41 is provided with a connecting plate 43. The coil 9 is wrapped around the cylindrical shaft 41. One end of the yoke 8 belongs to U-shaped end 81. The iron core penetrates through the cylindrical shaft 41 for riveting with another end 82 of the yoke. Back plate 42 is located inside another end 82 of the yoke 8. The end of iron core 7 is located at the center of U-shaped end 81 of the yoke 8 to form an E shape with U-shaped end 81. A side wall 44 of coil former 4 is integrated on both sides of the connecting plate 43, respectively. The lower end of the connecting plate 43 is integrated with a base plate 45. A slot 46 used to insert U-shaped end 81 of the yoke 8 is provided between the side wall 44 and the base plate 45. A connecting hole 441 is provided on the side wall 44.

Magnetic enclosure 6 comprises a magnetic steel 62 and an armature 63 vertically located on both ends of the magnetic steel 62, respectively, through injection. Two armatures 63 and the magnetic steel 62 are formed into a U shape. The two armatures 63 are collaterally inserted into the gap 1 that is formed by the iron core 7 and the yoke 8 for proper alignment. One side of the magnetic enclosure 6 opposite to the armature 63 is thick at the center and thin on both ends. The magnetic enclosure 6 is integrated with a coupling shaft 611. The coupling shaft 611 is installed inside the connecting hole 441 of the coil former 4. A chute 442 that can facilitate installation of the coupling shaft 611 is provided inside the side wall 44.

The contact part comprises a dynamic and static contact pairs 22 as inserted into the base seat 2. The dynamic contact pair comprises a dynamic contact clip 21 and a dynamic contact point (not illustrated). Push rod 5 comprises a push seat 51 and two push arms 52 as integrated with the push seat 51. The push seat 51 is provided with a mounting hole 53.

The magnetic enclosure 6 is integrated with a push shaft 612. The push shaft 612 is inserted into the mounting hole 53 of push rod 5. The upper end of the insulation sleeve 3 is provided with a push groove 31 with position corresponding to the push arm 52 of push rod 5. The push arm 52 penetrates through the push groove 31. The end of push arm 52 is provided with two opposite slots 54. The upper end of the dynamic contact clip 21 is provided with two U-notches 211 corresponding to the push arm 52. The part of dynamic contact clip 21 located on both sides of the two U-notches 211 is inserted into the slot 54. A positioning slot 32 is integrated on both sides of the lower end of the insulation sleeve 3, respectively. A positioning block 23 is integrated on the base seat 2. Positioning slot 32 is clamped to the positioning block 23.

What is claimed is:

1. A mini high-power magnetic latching relay, comprising a base seat, an insulation sleeve, a push rod, a magnetic circuit, and a contact part, wherein:

said magnetic circuit comprises a magnetic enclosure, an iron core, a yoke, and a winding;

said winding comprises a coil former and a coil wrapped on said coil former;

one end of said yoke is a U-shaped end;

said iron core penetrates through said coil for forming a fixed connection with the other end of said yoke;

one end of said iron core is located at the center of said U-shaped end of said yoke to form an E-shaped gap;

said magnetic enclosure is formed by a magnetic steel and two armatures vertically located on both ends of said magnetic steel through injection;

a shaft of said magnetic enclosure is connected to said coil former;

said two armatures and said magnetic steel are formed into a U shape;

said two armatures are collaterally inserted into said E-shaped gap for alignment;

said contact part comprises a dynamic contact pair and a static contact pair inserted into said base seat;

said dynamic contact pair comprises a dynamic contact clip and a dynamic contact point;

one end of said push rod is connected to said magnetic enclosure and the other end of said push rod is connected to said dynamic contact clip;

said push rod comprises a push seat and two push arms integrated with said push seat;

said push seat is tapped with a mounting hole;

said magnetic enclosure is integrated with a push shaft;

said push shaft is inserted into said mounting hole;

an upper part of said insulation sleeve is provided with two push grooves with a position corresponding to that of said push arm;

said push arm penetrates through said push groove;

the end of said push arm is provided with two opposite slots;

an upper part of said dynamic contact clip is provided with two U-notches with a position corresponding to that of said push arm; and the upper part of said dynamic contact clip as located on both sides of said U-notches is clamped into said slots.

2. The mini high-power magnetic latching relay according to claim 1, wherein a positioning slot is integrated on both sides of a lower end of said insulation sleeve, respectively; said base seat is integrated with a positioning block; and said positioning slot is coupled with said positioning block.

3. The mini high-power magnetic latching relay according to claim 1, wherein one side of said magnetic enclosure opposite to said two armatures is thick at the center and thin on both ends.

4. A mini high-power magnetic latching relay, comprising a base seat, an insulation sleeve, a push rod, a magnetic circuit, and a contact part, wherein:

said magnetic circuit comprises a magnetic enclosure, an iron core, a yoke, and a winding;

said winding comprises a coil former and a coil wrapped on said coil former;

one end of said yoke is a U-shaped end;

said iron core penetrates through said coil for forming a fixed connection with the other end of said yoke;

one end of said iron core is located at the center of said U-shaped end of said yoke to form an E-shaped gap;

said magnetic enclosure is formed by a magnetic steel and two armatures vertically located on both ends of said magnetic steel through injection;

a shaft of said magnetic enclosure is connected to said coil former;

said two armatures and said magnetic steel are formed into a U shape;

said two armatures are collaterally inserted into said E-shaped gap for alignment;

said coil former comprises a hollowed cylindrical shaft;

said cylindrical shaft is located inside said insulation sleeve;

said insulation sleeve is fixed and installed on said base seat;

one end of said cylindrical shaft is provided with a back plate;

another end of said cylindrical shaft is provided with a connecting plate;

said coil is wrapped on said cylindrical shaft;

said iron core penetrates through said cylindrical shaft for riveting with said yoke;

said back plate is located on an inner side of said the other end of said yoke;

a side wall is integrated on both sides of said connecting plate;

said side wall is provided with a connecting hole;

said magnetic enclosure is integrated with a coupling shaft;

said coupling shaft is installed inside said connecting hole;

lower end of said connecting plate is integrated with a base plate; and a slot is provided between said side wall and said base plate for insertion of said U-shaped end of said yoke.

5. The mini high-power magnetic latching relay according to claim 4, wherein a chute that facilitates installation of said magnetic enclosure on said coupling shaft is provided inside said side wall.

6. The mini high-power magnetic latching relay according to claim 4, wherein a positioning slot is integrated on both sides of a lower end of said insulation sleeve, respectively; said base seat is integrated with a positioning block; and said positioning slot is coupled with said positioning block.

7. The mini high-power magnetic latching relay according to claim 4, wherein one side of said magnetic enclosure opposite to said two armatures is thick at the center and thin on both ends.

* * * * *